United States Patent [19]

Richey

[11] 4,363,360

[45] Dec. 14, 1982

[54] APPARATUS FOR USE IN MAINTAINING A WELL PIPE CENTERED WITHIN A WELL BORE

[76] Inventor: Vernon T. Richey, 1111 Blalock, #29, Houston, Tex. 77055

[21] Appl. No.: 225,301

[22] Filed: Jan. 15, 1981

[51] Int. Cl.[3] ..... E21B 17/10

[52] U.S. Cl. ..... 166/241; 411/393

[58] Field of Search ..... 166/241, 172, 173, 175; 308/4 A; 411/393

[56] References Cited

U.S. PATENT DOCUMENTS

| | | | |
|---|---|---|---|
| 1,831,856 | 11/1931 | Fullmen | 411/393 |
| 2,903,073 | 9/1959 | Coyle | 166/172 |
| 2,986,417 | 5/1961 | Baker | 166/241 |
| 3,200,884 | 8/1965 | Solum et al. | 166/241 |

*Primary Examiner*—William F. Pate, III

*Attorney, Agent, or Firm*—Vaden, Eickenroht, Thompson, Bednar & Jamison

[57] ABSTRACT

There is disclosed apparatus for use in maintaining a well pipe centered within a well bore, including a centralizer adapted to be disposed about the pipe, and stop collars above and below the centralizer for limiting endwise movement of the centralizer as a whole, while permitting its outwardly bowed springs to expand and contract.

13 Claims, 6 Drawing Figures

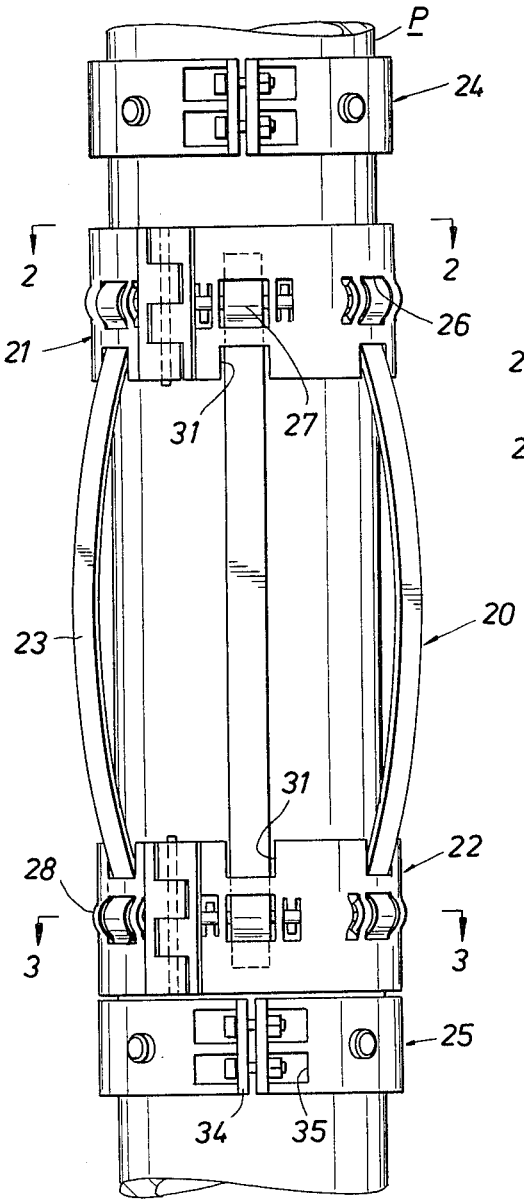
FIG. 1
FIG. 2
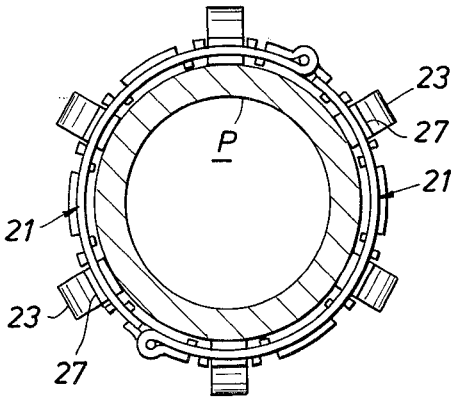
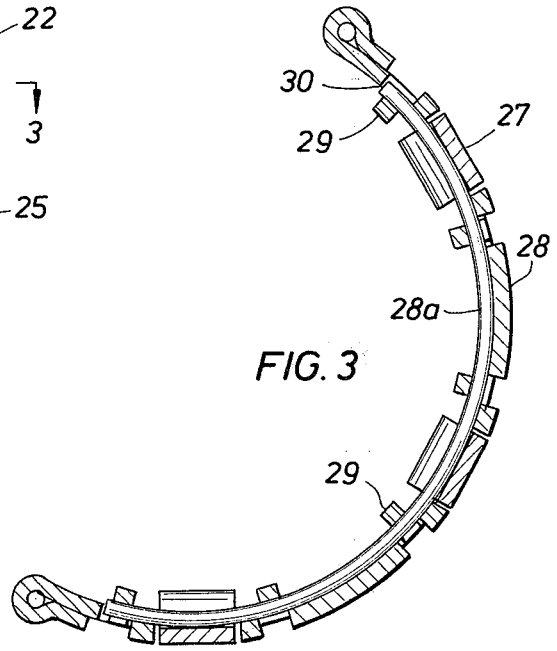
FIG. 3

FIG. 4
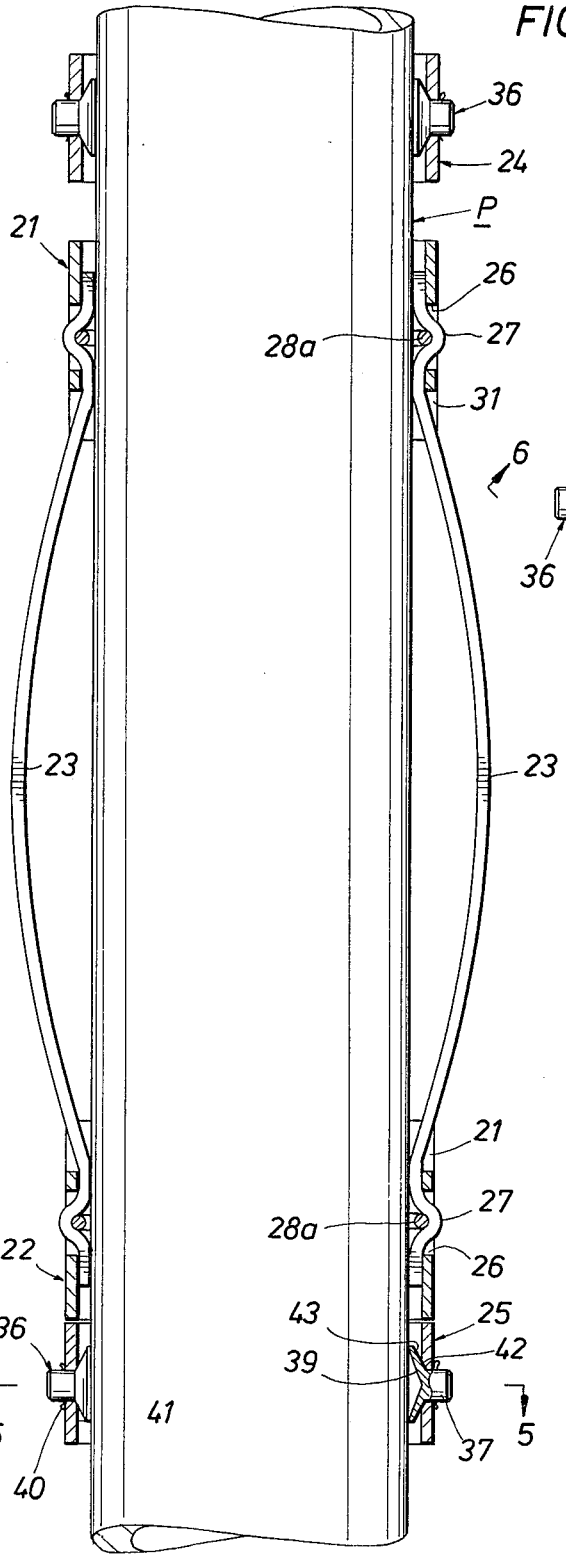
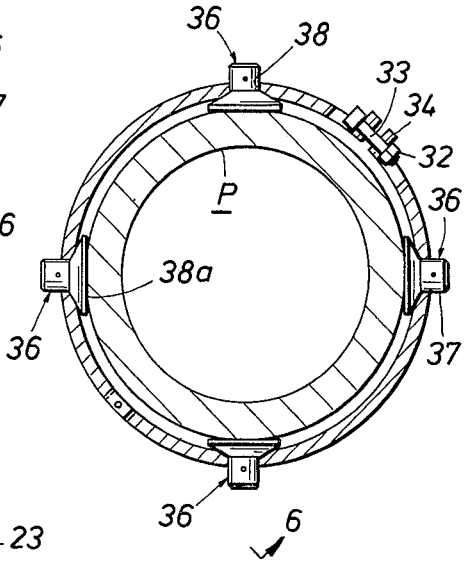
FIG. 5
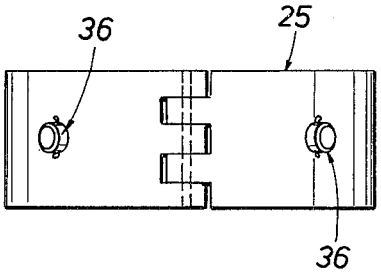
FIG. 6

APPARATUS FOR USE IN MAINTAINING A WELL PIPE CENTERED WITHIN A WELL BORE

This invention relates in general to apparatus for use in maintaining a well pipe centered within a well bore. More particularly, in accordance with one of its novel aspects, this invention relates to an improved centralizer, and, in accordance with another novel aspect, it relates to an improved stop collar for use in limiting movement of a centralizer or similar tool axially of the pipe.

As well known in the art, centralizers are ordinarily supported on the pipe at vertically spaced locations along its length. They comprise upper and lower sleeves adapted to be disposed about the pipe, and springs having opposite ends connected to the sleeves and outwardly bowed midportions intermediate their ends which are adapted to yieldably engage the well bore at circumferentially spaced locations thereabout. The well pipe may be a casing disposed within an open hole or within another casing—and in either event within a well bore—which, when centered, permits a uniform column of cement to be pumped into the annular space between it and the well bore.

When disposed about the pipe, the centralizers are supported for limited endwise movement by one or more stop collars which are adapted to be fixedly clamped about the pipe. Thus, a pair of such collars may be clamped to the pipe above and below the centralizer sleeves, or a single collar may be clamped thereto intermediate the sleeves. In either case, the collar or collars are so located relative to the sleeves that the sleeves are free to move toward and away from one another as the bowed springs expand and contract to permit the centralizers to function in well bores of somewhat different diameters.

Normally, the centralizer sleeves comprise circumferentially separated segments which are hingedly connected along one pair of edges to permit them to be wrapped around the pipe and then latched to one another along their free edges. In many cases, the ends of the bowed springs are connected to the sleeves by welding which may interfere with metallurgical properties of the heat treated springs. Also, when welded to one another, the sleeves and springs cannot be stored and/or shipped in broken down, compact arrangements. In other cases, the ends of the springs are connected to the sleeves by threaded parts or other fasteners requiring expensive and complicated assembly and fabrication procedures.

Prior clamp stop collars of which I'm aware have comprised sleeves which are adapted to be drawn about the pipe in order to force parts on their inner circumference into tight engagement with the pipe. Heretofore, these pipe engaging parts have comprised set screws or the like which require separate manipulation, or inwardly protruding parts on the sleeve which cannot be relied upon to tightly engage the pipe.

An object of this invention is to provide a centralizer in which the ends of the bowed springs are connected to the sleeves without welding or fasteners of the type described.

Another object of the invention is to provide a stop collar which has parts which are tightly engaged with the pipe as the sleeve thereof is drawn thereabout.

These and other objects are accomplished, in accordance with the illustrated embodiment of the present invention, by a centralizer in which each of the upper and lower sleeves has windows thereabout, the opposite ends of the springs have portions which protrude into the windows, and arcuate rods fit within the protruding portions of the springs. More particularly, the sleeves are provided with means for limiting endwise movement of the rods as well as radial movement thereof away from the protruding portions of the springs within the windows, whereby the ends of the springs are connected to the sleeves with their bowed portions arranged to yieldably engage the well bore at circumferentially spaced locations about the well bore. Since this connection is made without welding, there is no risk of upsetting the metallurgical balance of the springs, and the sleeves and springs may be stored and/or shipped in unassembled relation. Furthermore, the parts for connecting the sleeves and springs to one another are relatively expensive to fabricate.

In the preferred and illustrated embodiment of the invention, the radial movement of the rods is limited by means of tabs which are cut from the sleeves to engage the sides of the rods opposite the protruding portions of the springs. More particularly, there are at least a pair of tabs on each sleeve segment, one of which extends downwardly and the other of which extends upwardly to cooperate with the protruding portions in limiting movement of the rods axially of the sleeves.

In the illustrated embodiment of the invention, the opposite ends of the springs are connected to the inner sides of the sleeves, and have tabs on the outer ends of their bent portions which lie against the inner sides of the sleeves. More particularly, each sleeve segment has an outwardly bent, circumferential portion in which the windows are formed to receive outwardly protruding bent portions of the ends of the springs. When the rods are fitted within the outwardly bent portions of the springs and sleeves, their inward radial movement is limited by tabs which are cut from the outwardly bent portion of each sleeve segment, and their endwise movement is limited by shoulders on the sleeve segments at each end of the outwardly bent portion thereof.

The stop collar made in accordance with the illustrated embodiment of the present invention comprises a circumferentially split sleeve having means to draw its free edges together in order to draw the sleeve as a whole about the pipe, and shoes carried by the sleeve for engaging the pipe at substantially equally circumferentially spaced locations as the sleeve is drawn about it. More particularly, each shoe includes a pin mounted within a hole in the sleeve, and a cup on the inner end of the pin having a concave end surface whose periphery engages the pipe. Preferably, the inner circumference of the sleeve has a substantially conical, concave surface engageable with a similarly shaped surface on the outer side of the cup in order to wedge the cup inwardly against the pipe as the sleeve is drawn about the pipe. Thus, the sharp edge of the periphery of the end surface of the cup is caused to bite into the pipe, and thus fixedly clamp the collar about the pipe, as the free edges of the sleeve are drawn together.

In the drawings, wherein like reference characters are used throughout to designate like parts:

FIG. 1 is a side elevational view of a centralizer constructed in accordance with the present invention and disposed about a well pipe, together with stop collars also constructed in accordance with the present invention and clamped about the well pipe above and below the centralizer so as to limit its endwise movement;

FIG. 2 is a top view of the centralizer, as seen along broken lines 2—2 of FIG. 1;

FIG. 3 is an enlarged cross-sectional view of a segment of the lower sleeve of the centralizer, as seen along broken lines 3—3 of FIG. 1;

FIG. 4 is a vertical sectional view of the centralizer and stop collars, as seen in FIG. 1 but on a somewhat larger scale;

FIG. 5 is a cross-sectional view of the lower stop collar, as seen along broken lines 5—5 of FIG. 4; and FIG. 6 is a side elevational view of the lower stop collar, as seen along broken lines 6—6 of FIG. 5.

The centralizer best shown in FIG. 1 and indicated in its entirety by reference character 20, comprises upper and lower sleeves 21 and 22 disposed about a well pipe P, and springs 23 having their opposite ends connected to the upper and lower sleeves and outwardly bowed, midportions adapted to yieldably engage the well bore. More particularly, and as best shown in FIG. 2, there are six such springs 23 connected to and extending between the sleeves at substantially equally circumferentially spaced-apart locations about the pipe, although a greater or lesser number of springs may be used if desired. As previously described, the pipe P may be a well casing, and the well bore (not shown) may be the open hole of a well, or another outer casing within the well.

As will be described in detail to follow, each of the sleeves 21 and 22 is free to move within limits in a direction axially of the well pipe P, and thus to move toward or away from one another during expansion and contraction of the springs 23. When the springs are of sufficient strength, their outwardly bowed midportions may be of such size that, when unstressed, they describe a circle of slightly smaller diameter than that of the well bore in which they are to be disposed, whereby the centralizer is easily moved vertically within the well bore. In the case of weaker springs, however, these portions may describe a circle of somewhat larger diameter so that the springs will be inwardly stressed and the sleeves moved away from one another as the centralizer is installed within the well pipe in the well bore. Then, as the well pipe is moved vertically within the well bore, the springs are free to expand or contract further in order to accommodate minor variations in the well bore diameter.

Endwise movement of the centralizer as a whole is limited by means of upper and lower collars 24 and 25 which are clamped about the well pipe above and below the upper and lower sleeves 21 and 22, respectively, of the centralizer. More particularly, the collars are axially spaced from one another a distance greater than the axial dimension of the centralizer when the springs are unstressed, and preferably somewhat greater than the expected movement of the upper and lower sleeves of the centralizer away from one another as the springs are contracted, so that while limiting endwise movement of the centralizer as a whole, the clamps permit the expansion and contraction of the springs of the centralizer. As also known in the art, these same functions may also be accomplished by disposal of one such stop collar intermediate the upper and lower sleeves of the centralizer.

Each of the upper and lower sleeves 21 and 22 of the centralizer is of substantially identical construction, and comprises a pair of semi-circular segments having one pair of adjacent edges hingedly connected together and the opposite free edges adapted to be latched to one another when the segments are wrapped around the well pipe. As will be described to follow, the hinged edges as well as the lat' .es are of a well known interlocking type which form eyes to receive a hinge pin or a latch pin. When latched to one another about the pipe, the sleeve segments have an inner circumference spaced from the outer diameter of the pipe so as to receive the ends of the springs therebetween, as best shown in FIG. 4.

Each sleeve segment is provided with three equally spaced-apart windows 26 each to receive a protruding portion 27 on the end of a spring. More particularly, the windows are so arranged as to be equally spaced apart and thus to arrange the springs in equally spaced-apart relation.

The protruding portions 27 on the ends of the springs are retained within the windows 26 so as to connect the springs to the sleeves by means of arcuate rods 28*a* which fit within the protruding portions. More particularly, there are a pair of such rods 28*a*, each being bent to a diameter substantially equal to that of the segments of the sleeve and extending in an arc of somewhat less than 180°, and a means is provided for limiting endwise as well as inward radial movement of the rods away from the protruding portions of the springs within the windows.

Inward radial movement of the rods is limited by means of tabs 29 which are cut or struck from the sleeve, with alternate tabs extending upwardly and downwardly. In either case, the tabs are disposed on the inner sides of the rods 28*a* so as to limit their inward movement away from the inner sides of the protruding portions 27 of the springs. More particularly, pairs of upwardly and downwardly extending tabs are arranged on opposite sides of each window.

As shown in FIG. 3, a circumferential portion 28 of each sleeve segment in which the windows 26 and tabs 29 are formed is bent outwardly a distance equal to about one-half the thickness of the sleeve segment. The tabs 29 are also bent inwardly about the same distance to dispose their inner sides substantially aligned with the inner diameter of the unbent portion of the sleeve segment. The inner sides of the outwardly bent portions 27 on the ends of the springs are substantially aligned with the inner sides of the circumferential bent portion 28 of the sleeve segment, so that an arcuate rod 28*a* of a diameter substantially equal to the thickness of the sleeve segment will be retained closely between the inner sides of the tabs and the oppositely facing, inner sides of the outwardly bent portions 27 of the springs and the outwardly bent portions 28 of the sleeve segments.

As shown in FIG. 3, the eye along each end edge of a sleeve segment is formed by a folded over, outer strip, the strip and the end of the segment over which it is folded being cut out to permit interlocking with the adjacent edge of the other segment. As shown in FIG. 3, the ends of rods 28*a* are opposite and close to a shoulder 30 on the sleeve segment at the end of the circumferentially bent portion 28 to thereby limit endwise movement of the rod.

As will be appreciated, during connection of the ends of the springs to the sleeves, the tabs 29 will be at substantially right angles to the sleeve to permit the rods 28*a* to be moved between their ends and into place close to the inner sides of the outwardly bent portions of the ends of the springs and the sleeve segments. The tabs may then be bent downwardly or upwardly to move their inner sides against the inner sides of the rods, as best shown in FIG. 3. This simple assembly procedure makes it possible to store and ship the centralizer in an unassembled condition—i.e., with the sleeve segments as well as the springs stacked one within the other.

As shown, tabs on the upper and lower ends of each spring above and below the protruding portions thereof project upwardly and downwardly, respectively, beyond the windows in which their protruding portions are received. Hence, these tabs strengthen the connection of the springs to the sleeves. As also shown, the lower end of the upper sleeve and the upper end of the lower sleeve are relieved at 31 to receive the outwardly bowed portions of the springs.

Each of the stop collars 24 also comprises a sleeve having a pair of semi-circular segments hingedly connected along one pair of edges and adapted to have their opposite edges drawn toward one another to clamp the collars about the well pipe P above and below the centralizer 20. The hingedly connected edges of the sleeve segments are of piano construction having eyes for receiving a hinge pin, as in the case of the sleeve segments of the sleeve segments of the centralizer. The opposite pair of edges of the sleeve are connected by a pair of nuts 32 and bolts 33 which permit the edges to be drawn together so as to in turn draw the inner diameter of the clamp about the well pipe P. Thus, each of these edges is provided with an outturned flange 34 through which the bolts 33 extend, and the nuts 32 may be threaded over the ends of the bolts to draw the flanges toward one another. Holes 35 may be formed in the segments of the stop collar adjacent the flange so as to receive the enlarged heads of the bolts as well as the nuts 32.

A plurality of shoes 36 are carried by the stop collar sleeve at substantially equally spaced, circumferentially spaced locations about the pipe. Thus, as shown in FIG. 5, there are four such shoes for engaging the pipe at 90° intervals about its circumference. Each such shoe includes a pin 37 which is received within a hole 38 extending through the stop collar sleeve, and a cup 38*a* on the inner end of the pin having a concave end surface 39 whose periphery engages the pipe, as can be seen in FIG. 4. The pins project from the holes, and the shoes are prevented from falling from the inner circumference of the stop collar sleeve, during assembly about the pin by means of cotter pins 40 extending through the pins adjacent the outer diameter of the stop collar sleeve. A substantially conically shaped, concave surface 41 is formed on the inner diameter of the stop collar sleeve to surround the inner end of each hole. This sleeve surface is adapted to be engaged by a similar shaped surface 42 on the outer side of the cup so as to wedge the sharp inner edge of the cup inwardly against the pipe as the sleeve is drawn about the pipe. Preferably, the radially outer portion 43 of the outer side of each cup is unsupported by the inner diameter of the stop collar sleeve.

The portion of each pin 37 which protrudes outwardly from the outer circumference of the sleeve may be engaged by a hammer or the like to force the edges of the cups into tighter engagement with the pipe. Although each stop collar is shown to have four shoes, it may have three shoes, or any number greater than four for engaging the pipe at circumferentially equally spaced-apart locations.

When the sleeve segments of the centralizer are connected about the pipe, the inner circumference of the sleeve is spaced radially outwardly from the pipe a distance which is preferably somewhat greater than the thickness of the springs, so that the inner ends of the springs will not interfere with connection of the free ends of the sleeves.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A centralizer for maintaining a well pipe centered within a well bore, comprising upper and lower sleeves adapted to be disposed about the pipe in axially spaced relation, a plurality of springs having bowed portions intermediate their opposite ends, each sleeve having windows thereabout, the opposite ends of the springs having portions which protrude outwardly into the windows, arcuate rods also being received within the sleeve and fitting within the protruding portions of the spring, and means on the sleeves for limiting endwise as well as radial movement of the rods away from the protruding portions of said springs within said windows, whereby the ends of the springs are connected to the sleeves with their bowed portions arranged to yieldably engage the well bore at circumferentially spaced locations about the well bore.

2. A centralizer of the character defined in claim 1, wherein the means for limiting radial movement of the rods comprises tabs which extend under the sleeve and then are cut from the sleeves to engage sides of the rods opposite the protruding portions of the springs.

3. A centralizer of the character defined in claim 2, wherein the tabs are arranged in pairs, with one tab of each pair extending downwardly and the other tab of each pair extending upwardly so as to limit movement of the rods axially of the sleeves.

4. A centralizer of the character defined in claim 3, wherein the tabs of each pair are on opposite sides of each window.

5. A centralizer for maintaining a well pipe centered within a well bore, comprising upper and lower sleeves adapted to be disposed about the pipe in axially spaced relation, a plurality of springs having bowed portions intermediate their opposite ends, and each sleeve having an outwardly bent, circumferential portion and windows formed in such portion, the opposite ends of the springs having outwardly bent portions which are received within the windows, arcuate rods fitting within the outwardly bent portions of the springs and sleeves, and means on the sleeves for limiting endwise as well as radial movement of the rods away from the protruding portions of said springs within said windows, whereby the ends of the springs are connected to the sleeves with their bowed portions arranged to yieldably engage the well bore at circumferentially spaced locations about the well bore.

6. A centralizer of the character defined in claim 5, wherein the means for limiting inward radial movement of the rods comprises tabs which are cut from the outwardly bent portions of the sleeves to engage sides of the rods opposite the protruding portions of the springs.

7. A centralizer of the character defined in claim 6, wherein there are at least a pair of tabs on each sleeve segment, one such tab extending upwardly and the other downwardly so as to limit movement of the rods axially of the sleeves.

8. A centralizer of the character defined in claim 7, wherein the tabs of each pair are on opposite sides of each window.

9. A centralizer of the character defined in claim 5, wherein the means for limiting endwise movement of the rods comprise shoulders on each sleeve at each end of the outwardly bent portion thereof.

10. Apparatus for use in maintaining a well pipe centered within a well bore, comprising a centralizer having upper and lower sleeves adapted to be disposed about the pipe and springs having opposite ends connected to the sleeves and outwardly bowed portions intermediate such ends adapted to yieldably engage the well bore at circumferentially spaced locations thereabout, and at least one stop collar adapted to be fixedly mounted on the pipe in a location which limits endwise movement of the centralizer as a whole while permitting the sleeves to move relatively toward and away from one another as the springs expand and contract, each such collar comprising a circumferentially split sleeve having means to draw its free edges together in order to draw it about the pipe, and shoes carried by the sleeve at substantially equally, circumferentially spaced locations, each shoe including a pin mounted within a hole in the sleeve, and a cup on the inner end of the pin having a concave inner surface whose periphery engages the pipe, the inner circumference of the sleeve of the collar having a substantially conically shaped, concave surface engageable with a similarly shaped surface on the outer side of the cup to wedge the cup inwardly against the pipe as the collar sleeve is drawn about the pipe.

11. Apparatus of the character defined in claim 10, wherein the pin protrudes from the outer circumference of the collar sleeve.

12. A stop collar adapted to be clamped about a well pipe within a well bore in order to limit endwise movement of a centralizer or like tool disposed about said pipe, said collar comprising a circumferentially split sleeve having means to draw its opposite edges together in order to draw it about the pipe, and shoes carried by the sleeve at substantially equally, circumferentially spaced locations, each shoe including a pin mounted within a hole in the sleeve, and a cup on the inner end of the pin having a concave inner surface whose periphery engages the pipe, the inner circumference of the sleeve having a substantially conical, concave surface engageable with a similarly shaped surface on the outer side of the cup to wedge the cup inwardly against the pipe as the sleeve is drawn about the pipe.

13. A stop collar of the character defined in claim 12, wherein the pin protrudes from the outer circumference of the sleeve.

* * * * *